United States Patent [19]

Busch et al.

[11] Patent Number: 4,680,131

[45] Date of Patent: Jul. 14, 1987

[54] DETERGENT COMPOSITIONS

[75] Inventors: Alfred Busch, Grimbergen; James C. T. B. St. Laurent, Overijse, both of Belgium

[73] Assignee: The Proctor & Gamble Company, Cincinnati, Ohio

[21] Appl. No.: 818,414

[22] Filed: Jan. 13, 1986

Related U.S. Application Data

[63] Continuation of Ser. No. 598,652, Apr. 10, 1984, abandoned.

[30] Foreign Application Priority Data

Apr. 20, 1983 [GB] United Kingdom ..... 8310698

[51] Int. Cl.[4] ..... C11D 7/54

[52] U.S. Cl. ..... 252/102; 252/98; 252/99; 252/140; 252/155; 252/174.25; 252/186.30

[58] Field of Search ..... 252/98, 99, 102, 140, 252/155, 174.25, 186.30

[56] References Cited

U.S. PATENT DOCUMENTS

| | | | |
|---|---|---|---|
| 3,211,658 | 10/1965 | Hirtz et al. | 252/99 |
| 3,583,924 | 6/1971 | Demangeon et al. | 252/102 |
| 3,991,000 | 11/1976 | Chazard et al. | 252/99 |
| 4,062,647 | 12/1977 | Storm et al. | 8/137 |
| 4,283,302 | 8/1981 | Foret et al. | 252/102 |
| 4,294,717 | 10/1981 | Couderc | 252/97 |

FOREIGN PATENT DOCUMENTS

| | | |
|---|---|---|
| 984459 | 2/1965 | United Kingdom . |
| 1192524 | 5/1970 | United Kingdom . |
| 1565807 | 4/1980 | United Kingdom . |

*Primary Examiner*—Paul Lieberman
*Assistant Examiner*—Hoa Van Le

[57] ABSTRACT

Laundry detergent compositions comprising from about 2% to about 60% of organic surfactant, from about 1% to about 20% of smectite-type clay selected from saponites, hectorites and sodium and calcium montmorillonites, from about 0.001 to about 0.4 mmoles % of copper precomplexed with an aminopolycarboxylate sequestrant, and from about 0.5% to about 50% of peroxygen bleaching agent and/or peroxygen bleach percursor therefor. The compositions provide improved bleaching activity.

5 Claims, No Drawings

DETERGENT COMPOSITIONS

This is a continuation of application Ser. No. 598,652, filed Apr. 10, 1984 abandoned.

TECHNICAL FIELD

The present invention relates to laundry bleaching and detergent compositions having improved bleaching effectiveness.

BACKGROUND

The use of peroxygen bleaching agents for washing clothes and other household articles has long been known. They are particularly valuable for removing stains having a significant content of colouring matter, for instance, tea, coffee, fruit, wine and cosmetic stains. Commonly, the bleaching agent takes the form of a peroxy salt such as sodium perborate or sodium percarbonate. This is typically added to a laundry detergent composition at a level in the range from about 5% to about 35% weight.

The effectiveness of peroxygen bleaching agents is known to be very variable, however, and is greatly affected by the level of heavy metal impurities in the wash water. Indeed, in the absence of these impurities, peroxygen bleaching agents have essentially minimal bleaching activity. Large quantities of heavy metal impurities, on the other hand, promote extensive decomposition of the bleaching agent with release of gaseous oxygen. For this reason, it has been common to add a sequestering agent such as ethylenediaminetetraacetic acid (EDTA) or its salts to provide a more uniform level of free heavy metal ions in solution. The effect of these sequesterants under normal conditions, however, is not only to control bleach decomposition but also to suppress the rate and level of bleaching activity.

A number of attempts have been made in the art to boost bleach performance by deliberate addition of heavy metal materials during the manufacturing process. Thus, in G.B.-A-984,459 a combination of a copper salt and a sequestering agent having a copper dissociation constant in the range from −11 to −15, is used together with a water-soluble perborate bleaching agent. The dissociation constant of the complex is such as to provide a level of free copper ions in solution in the range necessary for activation of the perborate. Unfortunately, however, the buffering capacity of the sequestrant in this type of system is relatively weak with the result that significant variation in the level of free copper ions can still occur. Where, on the other hand, a sequestrant of greater chelating power is used, such as EDTA, the level of free heavy metal ions in solution is reduced to such an extent that activation of the bleaching agent is minimal; in other words, the bleaching agent is "overstabilised".

In another approach described in G.B.-A-1,565,807, certain preformed iron (III)/chelate complexes are described for use with hydrogen peroxide bleach liberating persalts and are said to have a pronounced activating effect on the peroxygen bleach. The materials specified are iron (III) complexes of ethylenediaminetetraacetic acid, nitrilotriacetic acid, diethylenetriaminepentaacetic acid, and hydroxyethylethylenediaminetriacetic acid. This approach also suffers drawbacks however. In particular, the iron/chelate complexes are found to produce a significant increase in the level of fabric damage as a result of localised bleach catalysis at the fabric surface. Moreover, although bleach enhancement can be observed under ideal conditions (nil water hardness, "clean" wash loads), the chelate system is unable to handle the significant variations of heavy metal content introduced in the wash load or wash solution—in other words the system lacks robustness. Other deficiencies of the chelate system include inadequate fabric whiteness end-result, essentially nil bleach enhancement in lower temperature wash cycles (less than 60° C.), and incompatibility with organic bleach activator materials commonly used for boosting low temperature wash performance.

It has now been discovered that an effective yet robust bleach auxiliary system based on copper can be secured by the use of copper precomplexed with an aminopolycarboxylate sequestering agent in conjunction with certain natural clay minerals. Surprisingly, the system is effective in enhancing bleach performance, even at very low levels of copper and with strong chelating agents such as EDTA.

The present invention therefore provides a bleaching auxiliary for use with a peroxygen bleaching agent or laundry detergent, the auxiliary providing improved control of bleach activity over the range of wash temperatures, water hardness and soil load, with improved fabric whiteness end-result. It also provides laundry bleaching and detergent compositions having more effective and efficient usage of peroxygen bleaching agent, thereby delivering an increased bleaching performance for any given level of peroxygen bleach, or minimising the level of peroxygen bleach required for any given level of bleaching end-result performance. The invention also provides a bleach auxiliary system for catalysing bleach activity which is fully compatible with organic peroxyacid bleach parameters.

SUMMARY OF THE INVENTION

Accordingly the present invention provides a detergent composition comprising:

(a) from about 2% to about 60% of organic surfactant selected from anionic, nonionic, cationic ampholytic and zwitterionic surfactants and mixtures thereof, (b) from about 1% to about 20% of smectite-type clay selected from saponites, hectorites, sodium and calcium montmorillonites, and mixtures thereof, (c) from about 0.001 to about 0.4 mmoles % of copper precomplexed with aminopolycarboxylate sequestrant having a logarithmic copper stability constant of at least about 11, and (d) from about 0.5% to about 50% of peroxygen bleaching agent and/or peroxygen bleach precursor therefor.

The compositions of the invention will now be discussed in detail. All weight percentages herein are by weight of total composition, unless otherwise specified.

The copper complex herein is preformed prior to admixture with the remainder of the detergent composition and is based on an aminopolycarboxylate sequestrant having a logarithmic copper stability constant of at least about 11, preferably at least about 15. Literature values of stability constants are taken where possible (see Stability Constants of Metal-Ion Complexes, Special Publication No. 25, the Chemical Society, London). Otherwise, the stability constant is defined at 25° C. and 0.1 molar KCl, using a glass electrode method of measurement as described in Complexation in Analytical Chemistry by Anders Ringbom (1963).

Suitable aminopolycarboxylate sequestrants herein include: ethylenediaminetetraacetic acid, diethylenetriaminepentaacetic acid, hydroxyethylenediaminetriacetic acid, dihydroxyethylenediaminediacetic, nitrilotriacetic acid and water-soluble salts thereof, eg the alkali metal, alkaline earth metal and ammonium salts. Highly preferred is ethylenediaminetetraacetic acid (EDTA) and its salts.

The copper complex can generally be present at a level in the range from about 0.001 to about 0.4 mmoles %, preferably from about 0.002 to about 0.1 mmoles %, more preferably from about 0.005 to 0.02 mmoles %. It is a feature of the present invention that the complex is an effective bleach catalyst even in very low levels thereof.

A further essential component of the invention is a smectite type clay selected from saponites, hectorites and sodium and calcium montmorillonites (sodium and calcium here designating the principal inorganic cation of the clay).

While any of the above smectite-type clays can be incorporated in the compositions of the invention, particularly preferred smectite-type clays have ion-exchange capacities of at least about 50 meq/100 g clay, more preferably at least about 70 meq/100 g (measured, for instance, as described in "The Chemistry and Physics of Clays", p.p 264–265, Interscience (1979)). Especially preferred materials are as follows:

Sodium Montmorillonite

Brock
Volclay BC
Gelwhite GP
Thixo-Jel 1
Ben-A-Gel
Imvite

Sodium Hectorite

Veegum F
Laponite SP

Sodium Saponite

Barasym NAS 100

Calcium Montmorillonite

Soft Clark
Gelwhite L

Lithium Hectorite

Barasym LIH 200

The above clays are generally present at a level of from about 1% to about 20%, more preferably from about 2% to about 10% by weight of composition.

The compositions of the invention generally contain from about 2% to about 60%, preferably from about 5% to about 20% of organic surfactant selected from anionic, nonionic, cationic ampholytic and zwitterionic surfactants and mixtures thereof, up to about 90%, preferably from about 5% to about 60% of detergency builder selected from water-soluble inorganic or organic sequestrants and/or water-insoluble zeolites, and from about 0.5% to about 50% of peroxygen bleaching agent and/or bleach precursor therefor, preferably from about 5% to about 35% bleaching agent and from about 0.5% to about 5% of bleach precursor.

The laundry detergent compositions of the invention are preferably prepared as a dry mixture of at least three particulate components, a first component comprising clay, detergency builder and/or surfactant, a second component comprising the copper complex, and a third component comprising particulate peroxygen bleaching agent. Dry mixing the copper complex in particulate form is valuable for improving composition storage stability. The copper complex is preferably incorporated in a water-soluble or water-dispersible organic carrier having a melting point greater than about 30° C., especially greater than about 40° C.; or it can be incorporated in a water-soluble or water dispersible agglomerated matrix of solid inorganic diluent. Alternatively, the mixture of copper complex and organic carrier can itself be agglomerated with the solid inorganic diluent. Suitable organic carriers include $C_{16}$–$C_{24}$ fatty alcohols (e.g. hydrogenated tallow alcohol) having from about 10 to about 100, preferably about 14 to about 80 ethylene oxide units, polyethyleneglycols having a molecular weight of from about 400 to about 40,000, preferably from about 1,500 to about 10,000, $C_{12}$–$C_{13}$ fatty acids and esters and amides thereof, polyvinyl pyrrolidone of molecular weight in the range from about 40,000 to about 700,000, and mixtures thereof. Suitable inorganic diluents include alkali metal, alkaline earth metal and ammonium sulphates and chlorides, neutral and acid alkali metal carbonates, orthophosphates and pyrophosphates, and alkali metal crystalline and glassy polyphosphates. A preferred inorganic diluent is sodium tripolyphosphate. Suitable water-insoluble but dispersible diluents include the finely-divided natural and synthetic silicas and silicates, especially smectite-type and kaolinite-type clays such as sodium and calcium montmorillonite, kaolinite itself, aluminosilicates, and magnesium silicates and fibrous and microcrystalline celluloses. Suitable agglomerating agents for the inorganic diluents include the organic carrier materials described above, water, aqueous solutions or dispersions of the inorganic diluent materials described above, polymer solutions and latexes such as aqueous solutions of sodium carboxymethylcellulose, methylcellulose, polyvinylacetate, polyvinylalchohol, dextrins, ethylene vinylacetate copolymers and acrylic latexes. Other suitable components of the agglomerates include polydimethylsiloxanes, paraffin oils, paraffin waxes, microcrystalline waxes, hydrophobic silica, enzymes, organic bleach activators etc. The agglomerates can be prepared by admixing the copper complex with the organic carrier or aqueous agglomerating agent which is then sprayed onto inorganic diluent in a pan agglomerator, fluidized bed, Schugi mixer etc. Desirably, the agglomerate is substantially free of unbound water (i.e. the agglomerate contains less than about 5%, especially less than about 1% thereof of moisture removeable by air-drying at 25° C.), although water in the form of water of hydration etc. can, of course, be present.

Peroxygen bleaching agents suitable for use in the present compositions include hydrogen peroxide, inorganic peroxides, peroxy salts and hydrogen peroxide addition compounds, and organic peroxides and peroxy acids. Organic peroxyacid bleach precursors (bleach activators) can additionally be present.

Suitable inorganic peroxygen bleaches include sodium perborate mono- and tetrahydrate, sodium percarbonate, sodium persilicate, urea-hydrogen peroxide addition products and the clathrate $4Na_2SO_4{:}2H_2O_2{:}1NaCl$. Suitable organic bleaches include peroxylauric acid, peroxyoctanoic acid, peroxynonanoic acid, peroxydecanoic acid, diperoxydodecanedioic acid, diperoxyazelaic acid, mono- and diperoxyphthalic acid and mono- and diperoxyisophthalic acid. Peroxyacid bleach precursors suitable herein are disclosed in U.K.-A-2,040,983, highly preferred being peracetic acid bleach precursors such as tetraacetylethylenediamine, tetraacetylmethylenediamine, tetracetylhexylenediamine, sodium p-acetoxybenzene sulphonate, tetraacetylglycouril, pentaacetylglucose, octaacetyllactose, and methyl O-acetoxy benzoate. The $C_6$–$C_{19}$ acyl derivatives disclosed in British Patent Application No. 8,218,867 are also highly suitable, especially the linear $C_6$–$C_{10}$ acyl oxybenzene sulphonates and carboxylates. Bleach activators can be added at a weight ratio of bleaching agent to bleach activator in the range from about 40:1 to about 4:1. Surprisingly, it is found that the bleach auxiliary of the invention is effective in combination with a conventional bleach activator to provide improved bleaching across the whole range of wash temperatures.

A wide range of surfactants can be used in the present laundry compositions. A typical listing of the classes and species of these surfactants is given in U.S. Pat. No. 3,663,961 issued to Norris on May 23, 1972 and incorporated herein by reference.

Suitable synthetic anionic surfactants are water-soluble salts of alkyl benzene sulphonates, alkyl sulphates, alkyl polyethoxy ether sulphates, paraffin sulphonates, alpha-olefin sulphonates, alpha-sulpho-carboxylates and their esters, alkyl glyceryl ether sulphonates, fatty acid monoglyceride sulphates and sulphonates, alkyl phenol polyethoxy ether sulphates, 2-acyloxy alkane-1-sulphonate, and beta-alkyloxy alkane sulphonate.

A particularly suitable class of anionic surfactants includes water-soluble salts, particularly the alkali metal, ammonium and alkanolammonium salts or organic sulphuric reaction products having in their molecular structure an alkyl or alkaryl group containing from about 8 to about 22, especially from about 10 to about 20 carbon atoms and a sulphonic acid or sulphuric acid ester group. (Included in the term "alkyl" is the alkyl portion of acyl groups). Examples of this group of synthetic detergents which form part of the detergent compositions of the present invention are the sodium and potassium alkyl sulphates, especially those obtained by sulphating the higher alcohols ($C_{8-18}$) carbon atoms produced by reducing the glycerides of tallow or coconut oil and sodium and potassium alkyl benzene sulphonates, in which the alkyl group contains from about 9 to about 15, especially about 11 to about 13, carbon atoms, in straight chain or branched chain configuration, e.g. those of the type described in U.S. Pat. No. 2,220,099 and U.S. Pat. No. 2,477,383 and those prepared from alkylbenzenes obtained by alkylation with straight chain chloroparaffins (using aluminium trichloride catalysis) or straight chain olefins (using hydrogen fluoride catalysis). Especially valuable are linear straight chain alkyl benzene sulphonates in which the average of the alkyl group is about 11.8 carbon atoms, abbreviated as $C_{11.8}$ LAS, and $C_{12}$–$C_{15}$ methyl branched alkyl sulphates.

Other anionic detergent compounds herein include the sodium $C_{10-18}$ alkyl glyceryl ether sulphonates, especially those ethers of higher alcohols derived from tallow and coconut oil; sodium coconut oil fatty acid monoglyceride sulphonates and sulphates; and sodium or potassium salts of alkyl phenol ethylene oxide ether sulphate containing about 1 to about 10 units of ethylene oxide per molecule and wherein the alkyl groups contain about 8 to about 12 carbon atoms.

Other useful anionic detergent compounds herein include the water-soluble salts or esters of $\alpha$-sulphonated fatty acids containing from about 6 to 20 carbon atoms in the fatty acid group and from about 1 to 10 carbon atoms in the ester group; water-soluble salts of 2-acyloxy-alkane-1-sulphonic acids containing from about 2 to 9 carbon atoms in the acyl group and from about 9 to about 23 carbon atoms in the alkane moiety; alkyl ether sulphates containing from about 10 to 18, especially about 12 to 16, carbon atoms in the alkyl group and from about 1 to 12, especially 1 to 6, more especially 1 to 4 moles of ethylene oxide; water-soluble salts of olefin sulphonates containing from about 12 to 24, preferably aout 14 to 16, carbon atoms, especially those made by reaction with sulphur trioxide followed by neutralization under conditions such that any sultones present are hydrolysed to the corresponding hydroxy alkane sulphonates; water-soluble salts of paraffin sulphonates containing from about 8 to 24, especially 14 to 18 carbon atoms, and $\beta$-alkyloxy alkane sulphonates containing from about 1 to 3 carbon atoms in the alkyl group and from about 8 to 20 carbon atoms in the alkane moiety.

The alkane chains of the foregoing non-soap anionic surfactants can be derived from natural sources such as coconut oil or tallow, or can be made synthetically as for example using the Ziegler or Oxo processses. Water solubility can be achieved by using alkali metal, ammonium or alkanolammonium cations; sodium is preferred. Suitable fatty acid soaps can be selected from the ordinary alkali metal (sodium, potassium), ammonium, and alkylolammonium salts of higher fatty acids containing from about 8 to about 24, preferably from about 10 to about 22 and especially from about 16 to about 22 carbon atoms in the alkyl chain. Suitable fatty acids can be obtained from natural sources such as, for instance, from soybean oil, castor oil, tallow, whale and fish oils, grease, lard and mixtures thereof). The fatty acids also can be synthetically prepared (e.g., by the oxidation of petroleum, or by hydrogenation of carbon monoxide by the Fischer-Tropsch process). Resin acids are suitable such as rosin and those resin acids in tall oil. Napthenic acids are also suitable. Sodium and potassium soaps can be made by direct saponification of the fats and oils or by the neutralization of the free fatty acids which are prepared in a separate manufacturing process. Particularly useful are the sodium and potassium salts of the mixtures of fatty acids derived from tallow and hydrogenated fish oil.

Mixtures of anionic surfactants are particularly suitable herein, especially mixtures of sulphonate and sulphate surfactants in a weight ratio of from about 5:1 to about 1:5, preferably from about 5:1 to about 1:1, more preferably from about 5:1 to about 1.5:1. Especially preferred is a mixture of an alkyl benzene sulphonate having from 9 to 15, especially 11 to 13 carbon atoms in the alkyl radical, the cation being an alkali metal, preferably sodium; and either an alkyl sulphate having from 10 to 20, preferably 12 to 18 carbon atoms in the alkyl radical or an ethoxy sulphate having from 10 to 20, preferably 10 to 16 carbon atoms in the alky radical and an average degree of ethoxylation of 1 to 6, having an alkali metal cation, preferably sodium.

The nonionic surfactants useful in the present invention are condensates of ethylene oxide with a hydrophobic moiety to provide a surfactant having an average hydrophilic-lipophilic balance (HLB) in the range from about 8 to 17, preferably from about 9.5 to 13.5, more preferably from about 10 to about 12.5. The hydrophobic moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Examples of suitable nonionic surfactants include:

1. The polyethylene oxide condensates of alkyl phenol, e.g. the condensation products of alkyl phenols having an alkyl group containing from 6 to 12 carbon atoms in either a straight chain or branched chain configuration, with ethylene oxide, the said ethylene oxide being present in amounts equal to 3 to 30, preferably 5 to 14 moles of ethylene oxide per mole of alkyl phenol. The alkyl substituent in such compounds may be derived, for example, from polymerised propylene, diisobutylene, octene and nonene. Other examples include dodecylphenol condensed with 9 moles of ethylene oxide per mole of phenol; dinonylphenol condensed with 11 moles of ethylene oxide per mole of phenol; nonylphenol and di-isooctylphenol condensed with 13 moles of ethylene oxide.

2. The condensation product of primary or seconary aliphatic alcohols having from 8 to 24 carbons atoms, in either straight chain or branched chain configuration, with from 2 to about 40 moles, preferably 2 to about 9 moles of ethylene oxide per mole of alcohol. Preferably, the aliphatic alcohol comprises between 9 and 18 carbon atoms and is ethoxylated with between 2 and 9, desirably between 3 and 8 moles of ethylene oxide per mole of aliphatic alcohol. The preferred surfactants are prepared from primary alcohols which are either linear (such as those derived from natural fats or, prepared by the Ziegler process from ethylene, e.g. myristyl, cetyl, stearyl alcohols), or partly branched such as the Lutensols, Dobanols and Neodols which have about 25% 2-methyl branching (Lutensol being a Trade name of BASF, Dobanol and Neodol being Trade Names of Shell), or Synperonics, which are understood to have about 50% 2-methyl branching (Synperonic is a Trade Name of I.C.I.) or the primary alcohols having more than 50% branched chain structure sold under the Trade Name Lial by Liquichimica. Specific examples of nonionic surfactants falling within the scope of the invention include Dobanol 45-4, Dobanol 45-7, Dobanol 45-9, Dobanol 91-2.5, Dobanol 91-3, Dobanol 91-4, Dobanol 91-6, Dobanol 91-8, Dobanol 23-6.5, Synperonic 6, Synperonic 14, the condensation products of coconut alcohol with an average of between 5 and 12 moles of ethylene oxide per mole of alcohol, the coconut alkyl portion having from 10 to 14 carbon atoms, and the condensation products of tallow alcohol with an average of between 7 and 12 moles of ethylene oxide per mole of alcohol, the tallow portion comprising essentially between 16 and 22 carbon atoms. Secondary linear alkyl ethoxylates are also suitable in the present compositions, especially those ethoxylates of the Tergitol series having from about 9 to 15 carbon atoms in the alkyl group and up to about 11, especially from about 3 to 9, ethoxy residues per molecule.

The compounds formed by condensing ethylene oxide with a hydrophobic base formed by the condensation of propylene oxide with propylene glycol. The molecular weight of the hydrophobic portion generally falls in the range of about 1500 to 1800. Such synthetic nonionic detergents are available on the market under the Trade Name of "Pluronic" supplied by Wyandotte Chemicals Corporation.

Especially preferred nonionic surfactants for use herein are the $C_9$–$C_{15}$ primary alcohol ethoxylates containing 3–8 moles of ethylene oxide per mole of alcohol, particularly the $C_{12}$–$C_{15}$ primary alcohols containing 6–8 moles of ethylene oxide per mole of alcohol.

Cationic surfactants suitable for use herein include quaternary ammonium surfactants and surfactants of a semi-polar nature, for example amine oxides. Suitable quaternary ammonium surfactants are selected from mono $C_8$–$C_{16}$, preferably $C_{10}$–$C_{14}$ N-alkyl or alkenyl ammonium surfactants wherein remaining N positions are substituted by methyl, hydroxyethyl or hydroxypropyl. Suitable amine oxides are selected from mono $C_8$–$C_{20}$, preferably $C_{10}$–$C_{14}$ N-alkyl or alkenyl amine oxides and propylene-1,3-diamine dioxides wherein the remaining N positions are again substituted by methyl, hydroxyethyl or hydroxypropyl.

The laundry compositions of the invention can also contain up to about 90% of detergency builder, preferably from about 5% to about 60% thereof.

Suitable detergent builder salts useful herein can be of the polyvalent inorganic and polyvalent organic types, or mixtures thereof. Non-limiting examples of suitable water-soluble, inorganic alkaline detergent builder salts include the alkali metal carbonates, borates, phosphates, pyrophosphates, tripolyphosphates and bicarbonates.

Examples of suitable organic alkaline detergency builder salts are water-soluble polycarboxylates such as the salts of nitrilotriacetic acid, lactic acid, glycollic acid and ether derivatives thereof as disclosed in B.E.-A-821,368, 821,369 and 821,370; succinic acid, malonic acid, (ethylenedioxy)diacetic acid, maleic acid, diglycollic acid, tartaric acid, tartronic acid and fumaric acid; citric acid, aconitic acid, citraconic acid, carboxymethyloxysuccinic acid, lactoxysuccinic acid, and 2-oxy-1,1,3-propane tricarboxylic acid; oxydisuccinic acid, 1,1,2,2-ethane tetracarboxylic acid, 1,1,3,3-propanetetracarboxylic acid and 1,1,2,3-propane tetracarboxylic acid; cyclopentane cis, cis,cis-tetracarboxylic acid, cyclopentadienide pentacarboxylic acid, 2,3,4,5-tetra hydrofuran-cis, cis, cis-tetracarboxylic acid, 2,5-tetra-hydro-furan-cis-di-carboxylic acid, 1,2,3,4,5,6-hexane-hexacarboxylic acid, mellitic acid, pyromellitic acid and the phthalic acid derivatives disclosed in G.B.-A-1,425,343.

A further class of builder salts is the insoluble zeolite type which functions by cation exchange to remove polyvalent mineral hardness and heavy metal ions from solution. A preferred builder of this type has the formulation $Na_z(AlO_2)_z(SiO_2)_y.xH_2O$ wherein z and y are integers of at least 6, the molar ratio of z to y is in the range from 1.0 to about 0.5 and x is an integer from about 15 to about 264. Compositions incorporating builder salts of this type form the subject of G.B.-A-1,429,143 published Mar. 24, 1976, D.E.-A-2,433,485 published Feb. 6, 1975 and D.E.-A-2,525,778 published Jan. 2, 1976, the disclosures of which are incorporated herein by reference.

An alkali metal, or alkaline earth metal, silicate can also be present. The alkali metal silicate is preferably from about 3% to about 15%. Suitable silicate solids have a molar ratio of $SiO_2$/alkali metal$_2$O in the range from about 1.0 to about 3.3, more preferably from 1.5 to 2.0.

The compositions of the invention can be supplemented by all manner of detergent and laundering component, inclusive of suds suppressors, enzymes, fluorescers, photoactivators, soil suspending agents, anticaking agents, pigments, perfumes, fabric conditioning agents etc.

Suds suppressors are represented by materials of the silicone, wax, vegetable and hydrocarbon oil and phosphate ester varieties. Suitable silicone suds controlling agents include polydimethylsiloxanes having a molecular weight in the range from about 200 to about 200,000 and a kinematic viscosity in the range from about 20 to about 2,000,000 $mm^2/s$, preferably from about 3000 to about 30,000 $mm^2/s$, and mixtures of siloxanes and hydrophobic silanated (preferably trimethylsilanated) silica having a particle size in the range from about 10 millimicrons to about 20 millimicrons and a specific surface area above about 50 $m^2/g$. Suitable waxes include microcrystalline waxes having a melting point in the range from about 65° C. to about 100° C., a molecular weight in the range from about 4000–1000, and a penetration value of at least 6, measured at 77° C. by ASTM-D1321, and also paraffin waxes, synthetic waxes and natural waxes. Suitable phosphate esters include mono- and/or di-$C_{16}$–$C_{22}$ alkyl or alkenyl phosphate esters, and the corresponding mono- and/or di alkyl or alkenyl ether phosphates containing up to 6 ethoxy groups per molecule.

Enzymes suitable for use herein include those discussed in U.S. Pat. No. 3,519,570 And U.S. Pat. No. 3,533,139 to McCarty and McCarty et al issued July 7, 1970 and Jan. 5, 1971, respectively. Suitable fluorescers include Blankophor MBBH (Bayer AG) and Tinopal CBS and EMS (Ciba Geigy). Photoactivators are discussed in E.P.-A-57,088, highly preferred materials being zinc phthalocyanine, tri- and tetra-sulfonates. Suitable fabric conditioning agents include smectite-type clays as disclosed in G.B.-A-1,400,898 and di-$C_{12}$–$C_{24}$ alkyl or alkenyl amines and ammonium salts, especially ditallow and distearyl methylamine.

Anitredeposition and soil suspension agents suitable herein include cellulose derivatives such as methylcellulose, carboxymethylcellulose and hydroxyethylcellulose, and homo- or co-polymeric polycarboxylic acids or their salts in which the polycarboxylic acid comprises at least two carboxyl radicals separated from each other by not more than two carbon atoms. Polymer of this type are disclosed in G.B.-A-1,596,756 incorporated herein by reference. Preferred polymers include copolymers or salts thereof of maleic anhydride with ethylene, methylvinyl ether, acrylic acid or methacrylic acid, the maleic anhydride constituting at least about 20 mole percent of the copolymer. These polymers are valuable for improving whiteness maintenance, fabric ash deposition, and cleaning performance on clay, proteinaceous and oxidizable soils in the presence of transition metal impurities.

In the Examples which follow, the abbreviations used having the following designation:

| | |
|---|---|
| LAS: | Linear $C_{11.8}$ alkyl benzene sulphonate. |
| AS: | Sodium linear $C_{12-14}$ alcohol sulphate. |
| TAS: | Tallow alcohol sulphate. |
| MAO: | $C_{12}$–$C_{14}$ alkyl dimethylamine oxide. |
| CATAB: | Coconut alkyl trimethylammonium bromide |
| Dobanol 45-E-n: | A $C_{14-15}$ oxo-alcohol with n moles of ethylene oxide, marketed by Shell. |
| TAED: | Tetraacetyl ethylene diamine. |
| Silicate: | Sodium silicate having an $SiO_2$:$Na_2O$ ratio of 1.6:1. |
| Wax: | Microcrystalline wax - Witcodur 272 M.pt. 87° C. |
| Silicone Prill: | Comprising 0.14 parts by weight of an 85.15 by weight mixture of silanated silica and silicone granulated with 1.3 parts of sodium tripolyphosphate, and 0.56 parts of tallow alcohol condensed with 25 molar proportions of ethylene oxide. |
| Porphine: | Tri/tetra sulphonated zinc phthalocyanine. |
| Gantrex AN119: | Trade name for maleic anhydride/vinyl methyl ether co-polymer, believed to have an average molecular weight of about 240,000, marketed by GAF. This was prehydrolysed with NaOH before addition. |
| MA/AA: | Copolymer of 1:4 maleic/acrylic acid, average molecular weight about 80,000. |
| Brightener: | Disodium 4,4'-bis(2-morpholino-4-anilino-s-triazino-6-ylamino)stilbene-2:2'-disulphonate. |
| Imvite: | Sodium montmorillonite marketed by IMV. |
| DSMA: | Distearyldimethylamine. |

The present invention is illustrated by the following non-limiting examples:

EXAMPLES 1 TO 6

The following granular laundry compositions are prepared by admixing all ingredients apart from the Dobanol surfactant, bleach, silicone prill, enzyme and agglomerate, in a crutcher as an aqueous slurry at a temperature in the range from 70° C. to 90° C., adjusting the crutcher content of the slurry to within the range from 30% to 38% by weight, spray drying the slurry at a drying gas inlet temperature in the range from 275° C. to 330° C., admixing the bleach, silicone prill, enzyme and agglomerate, and where appropriate spraying the Dobanol surfactant onto the resulting granular mixture. All figures are given as % by weight.

| | 1 | 2 | 3 | 4 | 5 | 6 |
|---|---|---|---|---|---|---|
| LAS | 5 | 8 | — | 6.5 | 7 | 5 |
| AS | 4 | — | 9 | — | — | 3 |
| TAS | — | 4 | — | — | — | — |
| MAO | — | — | 1.8 | — | — | — |
| CATAB | — | 2 | 1 | 2 | 2 | — |
| Dobanol 45-E-7 | 3 | 6 | 5 | — | 5 | — |
| Dobanol 45-E-4 | — | — | — | — | 2 | — |
| Tallow Alcohol E-11 | — | — | — | 1 | — | 3 |
| TAED | 1 | — | 6 | — | — | — |
| Silicate | 6 | 5 | 3 | 7 | 4 | 10 |
| Wax | — | — | — | — | — | 2 |
| Silicone Prill | — | — | 2 | 2 | — | 0.5 |
| Gantrez AN119 | — | — | 0.8 | — | — | 1 |
| MA/AA | 2 | 1 | — | 1 | — | — |
| Brightener | 0.3 | 0.2 | 0.4 | 0.2 | 0.2 | 0.2 |
| Imvite | 5 | 8 | 10 | 2.5 | 4 | 5 |
| Sodium Perborate | 12 | 15 | 16 | 21 | 10 | 15 |
| Alcalase Enzyme | 0.6 | 1 | — | 0.3 | — | 0.8 |
| Sodium Tripolyphosphate | 30 | 28 | 25 | 27 | 28 | 30 |
| DSMA | — | — | — | 3.5 | — | — |
| Porphine | — | — | — | 0.01 | — | — |
| Agglomerate I | 5 | — | — | — | — | — |
| Agglomerate II | — | 2.2 | — | — | — | — |
| Agglomerate III | — | — | 1.5 | — | — | — |

-continued

| | 1 | 2 | 3 | 4 | 5 | 6 |
|---|---|---|---|---|---|---|
| Agglomerate IV | — | — | — | 1.5 | — | — |
| Agglomerate V | — | — | — | — | 2.5 | — |
| Agglomerate VI | — | — | — | — | — | 3 |
| Sodium Sulphate, Moisture and Miscellaneous | | | To 100 | | | |

In the above, Agglomerates I to VI have the compositions given below. Agglomerates I, II, IV and V are prepared by spraying th organic components onto a fluidized bed of sodium tripolyphosphate; Agglomerates III and VI are prepared by extrusion; and Agglomerate I is prepared using a drum agglomerator.

| | Agglomerate | | | | | |
|---|---|---|---|---|---|---|
| | I | II | III | IV | V | VI |
| Cu—EDTA | 0.2 | 0.5 | 1 | 0.2 | 0.5 | 1 |
| $TAE_{25}$ | 6.8 | 19.5 | — | 19.8 | 11 | 14 |
| PEG 4000 | — | — | 5 | — | 11 | — |
| TAED | — | — | — | — | — | 85 |
| $C_{12}$ Fatty Acid Amide | — | — | 5 | — | — | — |
| Polyvinylpyrrolidone | — | — | 1 | — | — | — |
| Dextrin | — | — | 4 | — | — | — |
| Alcalase Enzyme | — | — | 12 | — | — | — |
| Silicone | — | 10 | — | — | 11 | — |
| Silanated Silica | — | 0.5 | — | 1 | 0.5 | — |
| Wax | — | — | — | — | 6 | — |
| Paraffin Wax m.p. 50° C. | — | — | — | 2 | — | — |
| Paraffin Oil | — | — | — | 4 | — | — |
| Porphine | — | 0.5 | — | — | — | — |
| Sodium Tripolyphosphate (anhydrous) | 74 | 53 | — | 58 | 47 | — |
| Sodium Sulphate | — | — | 12 | — | — | — |
| Sodium Chloride | — | — | 50 | — | — | — |
| $TiO_2$ | — | — | 10 | — | — | — |
| Water | 19 | 16 | — | 15 | 13 | — |

The above compositions combine excellent storage-stability, fabric care and all-temperature detergency performance on bleachable-type stains. Improved performance is also obtained when the Copper-EDTA complex is replaced by the copper complexes of diethylenetriaminepentaacetic acid, hydroxyethylethylenediaminetriacetic acid, dihydroxyethylethylenediaminediacetic acid and nitrilotriacetic acid.

What is claimed is:

1. A laundry detergent composition comprising:

(a) from about 2% to about 60% of organic surfactant selected from the group consisting of anionic, nonionic, cationic, ampholytic and zwitterionic surfactants of the mixture thereof;

(b) from about 1% to about 20% of smectite-type clay selected from the group consisting of saponites, hectorites and sodium and calcium montmorillonites and mixtures thereof, (c) from about 0.005 to about 0.02 mmoles % of copper precomplexed with aminopolycarboxylate sequestrant having a logarithmic copper stability constant of at least about 11, said aminopolycarboxylate sequestrant being selected from the group consisting of ethylenediaminetetraacetric acid, diethylenetriaminepentaacetic acid, hydroxyethylethylenediaminediacetic acid, nitrilotriacetic acid, mixtures thereof and water-soluble salts, thereof, and (d) from about 0.5% to about 50% of perborate bleaching agent.

2. A composition according to claim 1 wherein the copper complex is incorporated in a water-soluble or water-dispersible organic carrier having a melting point greater than about 30° C. and/or in a water-soluble or water-dispersible agglomerated matrix of solid inorganic diluent.

3. A composition according to claim 1 wherein the smectite-type clay has a cation-exchange capacity of at least about 50 meq/100 g.

4. A composition according to claim 1 wherein the aminopolycarboxylate sequestrant is ethylenediaminetetraacetic acid and the perborate bleaching agent is sodium perborate.

5. The composition of claim 1 which is granular.

* * * * *

UNITED STATES PATENT AND TRADEMARK OFFICE

CERTIFICATE OF CORRECTION

PATENT NO. : 4,680,131

DATED : July 14, 1987

INVENTOR(S) : Alfred Busch et al

It is certified that error appears in the above-identified patent and that said Letters Patent is hereby corrected as shown below:

On the title page, change the Assignee to --The Procter & Gamble Company--

Claim 1 (column 12, line 9), change "of the mixture" to --and mixtures--

Claim 1 (column 12, line 22), change "salts, thereof" to --salts thereof--

Signed and Sealed this

Twenty-seventh Day of October, 1987

*Attest:*

DONALD J. QUIGG

*Attesting Officer*

*Commissioner of Patents and Trademarks*